US006607398B2

(12) United States Patent
Henningsen

(10) Patent No.: US 6,607,398 B2
(45) Date of Patent: Aug. 19, 2003

(54) CONNECTOR FOR A COAXIAL CABLE WITH CORRUGATED OUTER CONDUCTOR

(75) Inventor: Jimmy Henningsen, Naestved (DK)

(73) Assignee: Corning Gilbert Incorporated, Glendale, AZ (US)

( * ) Notice: Subject to any disclaimer, the term of this patent is extended or adjusted under 35 U.S.C. 154(b) by 0 days.

(21) Appl. No.: 10/034,513

(22) Filed: Dec. 21, 2001

(65) Prior Publication Data

US 2003/0119358 A1 Jun. 26, 2003

(51) Int. Cl.[7] ..... H01R 9/05
(52) U.S. Cl. ..... 439/578; 439/584; 439/610
(58) Field of Search ..... 439/578, 579, 439/580, 581, 582, 583, 584, 585, 607, 608, 610

(56) References Cited

U.S. PATENT DOCUMENTS

| | | | | | |
|---|---|---|---|---|---|
| 3,568,111 | A | | 3/1971 | Dyer et al. | 333/97 |
| 3,581,269 | A | | 5/1971 | Frey et al. | 339/94 |
| 3,678,446 | A | * | 7/1972 | Siebelist | 339/60 |
| 4,046,451 | A | | 9/1977 | Juds et al. | 339/177 R |
| 4,408,822 | A | * | 10/1983 | Nikiktas | 339/177 |
| 4,421,377 | A | | 12/1983 | Spinner | 339/177 |
| 4,831,346 | A | | 5/1989 | Brooker et al. | 333/260 |
| 4,842,553 | A | * | 6/1989 | Ingram | 439/583 |
| 5,137,470 | A | | 8/1992 | Doles | 439/578 |
| 5,154,636 | A | | 10/1992 | Vaccaro et al. | 439/583 |
| 5,167,533 | A | | 12/1992 | Rauwolf | 439/583 |
| 5,284,449 | A | | 2/1994 | Vaccaro | 439/583 |
| 5,334,051 | A | | 8/1994 | Devine et al. | 439/583 |
| 5,518,420 | A | | 5/1996 | Pitschi | 439/429 |
| 5,595,502 | A | | 1/1997 | Allison | 439/429 |
| 5,637,830 | A | * | 6/1997 | Hashizawa et al. | 174/84 |
| 5,766,037 | A | * | 6/1998 | Nelson | 439/583 |
| 5,795,188 | A | | 8/1998 | Harwath | 439/583 |
| 5,830,009 | A | | 11/1998 | Tettinger | 439/578 |
| 5,857,872 | A | | 1/1999 | Tettinger | 439/584 |
| 5,871,372 | A | | 2/1999 | Kanda et al. | 439/583 |
| 5,984,723 | A | | 11/1999 | Wild | 439/583 |
| 5,993,254 | A | | 11/1999 | Pitschi et al. | 439/584 |
| 6,019,635 | A | | 2/2000 | Nelson | 439/583 |
| 6,032,358 | A | | 3/2000 | Wild | 29/863 |
| 6,089,912 | A | * | 7/2000 | Tallis et al. | 439/584 |

(List continued on next page.)

FOREIGN PATENT DOCUMENTS

| | | |
|---|---|---|
| EP | 1 148 592 | 10/2001 |
| FR | 2 663 790 | 12/1991 |

*Primary Examiner*—Tho D. Ta
*Assistant Examiner*—Truc Nguyen
(74) *Attorney, Agent, or Firm*—Joseph M. Homa

(57) ABSTRACT

A connector for a coaxial cable where the cable comprises a corrugated outer conductor and a hollow inner conductor, where the corrugation is not helically wound, the connector including a main body to be electrically connected to the outer conductor and an outer bushing which can be displaced longitudinally relative to the main body, where the connector furthermore contains a clamping mechanism which includes a radially resilient bushing in contact with the inner surface of the outer conductor and a rigid ring member placed outside the outer conductor in the same region as the resilient bushing, such that the outer conductor during mounting of the connector on the cable is introduced in the gap formed between the resilient bushing and rigid ring member and such that a displacement of the outer bushing relative to the main body results in a decrease of the width of the gap, whereby a firm and reliable contact is established between the outer conductor and the main body. The introduction of the outer conductor in the gap produces an audible "click" and/or a tactilely perceptible vibration which makes it possible, during mounting, to ascertain, that a correct insertion of the outer conductor in the connector has indeed taken place.

11 Claims, 2 Drawing Sheets

U.S. PATENT DOCUMENTS

| | | | | | |
|---|---|---|---|---|---|
| 6,133,532 | A | * | 10/2000 | Lundback et al. | 174/88 |
| 6,148,513 | A | | 11/2000 | Schiefer et al. | 29/858 |
| 6,217,384 | B1 | | 4/2001 | Strasser et al. | 439/583 |
| 6,267,621 | B1 | | 7/2001 | Pitschi et al. | 439/584 |
| 6,322,390 | B1 | * | 11/2001 | Takeuchi | 439/578 |
| 6,386,915 | B1 | | 5/2002 | Nelson | 439/584 |
| 2001/0028289 | A1 | | 10/2001 | Pitschi et al. | 333/260 |

* cited by examiner

CONNECTOR FOR A COAXIAL CABLE WITH CORRUGATED OUTER CONDUCTOR

TECHNICAL FIELD

The present invention relates to electrical connectors and more particularly to connectors for coaxial cables with a corrugated outer conductor.

DESCRIPTION OF PRIOR ART

Various connectors for coaxial cables with a corrugated outer conductor are described in the literature. Some of these are specifically designed for cables with a helically wound corrugated outer conductor, in which case the helical outer conductor for instance can be utilized to screw the connector onto the cable. The present invention is however intended for corrugated outer conductors which are not helically wound.

Connectors for coaxial cables utilized in connection with high frequency transmission must obtain and maintain an optimal and highly reliable electrical connection between the outer conductor of the cable and the corresponding part of the connector in order to avoid intermodulation problems. Various prior art connectors address this particular problem.

U.S. Pat. No. 5,518,420 (Spinner GmbH) discloses a coaxial cable connector where a suitably prepared end of the outer conductor of a coaxial cable after proper insertion of the cable in the connector is clamped between an end part of the front portion or "main body" of the connector and a clamp bushing, where either said end part or said clamp bushing can be provided with beads, which beads due to the clamping force between said end part and said clamp bushing during mounting of the connector on the cable are pressed into the relatively soft material of the outer conductor thus contributing to a more permanently reliable contact between the outer conductor and the front portion of the connector. Somewhat similar connectors are also disclosed in U.S. Pat. Nos. 5,595,502 and 5,795,188 (Andrew Corporation), although these do not contain beads.

DISCLOSURE OF THE INVENTION

It is the object of the present invention to provide a connector for a coaxial cable with a corrugated outer conductor and a hollow inner conductor (which may also be corrugated), which connector facilitates reliable handling hereof during mounting on a coaxial cable with the aim to secure said optimal and reliable electrical connection not only during mounting of the connector on the cable but also during the whole operational life of the connector.

Accordingly, it is an object of the present invention to provide a connector for a coaxial cable with a corrugated outer conductor and a hollow inner conductor which connector makes it possible in an easy and reliable manner to ascertain that the correct final placement of the connector on the cable has in fact been obtained.

It is a further object of the present invention to provide a connector for a coaxial cable with a corrugated outer conductor and a hollow inner conductor which connector consists of a minimum of constituting parts and where the construction of the connector is such that the dimensions of the connector can be kept at a minimum, thus saving material during manufacture and saving space and weight, which is advantageous during transport and shipment of connectors.

These and other objects are achieved with a connector according to the characterizing clause of the independent claim. Various embodiments of the connector according to the invention are set forth in the dependent claims.

According to the present invention, there is thus provided a connector for a coaxial cable with a corrugated outer conductor and a hollow inner conductor, where said connector comprises the following components: a tubular main body to be placed coaxially on said cable and electrically connected to the outer conductor of the coaxial cable, said main body containing the center terminal of the connector, where a first end of said main body facing the coaxial cable consists of a tubular extension of a first diameter; a tubular bushing to be connected coaxially to said main body and which can be displaced longitudinally a certain, limited distance relative to said main body, for instance by screwing said bushing onto said main body with the aid of threads suitably positioned on an outer surface of said main body and on a corresponding inner surface of said bushing; a tubular, resilient bushing placed around said tubular extension of the main body, so that said tubular extension can slide longitudinally within said resilient bushing; a rigid ring member placed coaxially around said resilient bushing in engagement partly herewith and partly with said bushing and forming a circular gap between said resilient bushing and said rigid ring member, the width of said gap being suitably dimensioned to be able to contain an end portion of the outer conductor of the coaxial cable, and where said width of said gap is being brought to decrease when said resilient bushing is being displaced longitudinally over said tubular extension of the main body in the direction towards that end of the connector facing away from the coaxial cable, so that said end portion of the outer conductor of the coaxial cable thereby is being retained firmly within said gap and such that a reliable electrical contact is herewith established between said outer conductor and said main body; a center terminal of the connector attached to said main body via an intermediate tubular insulator and positioned coaxially with said other parts of the connector and with the coaxial cable, said center terminal is introduced within the interior of said hollow inner conductor of the coaxial cable and thereby establishes a reliable electrical contact between the center terminal and the inner conductor.

According to the present invention, said resilient bushing is at the end thereof facing the coaxial cable provided with a radially outwardly extending circumferential protrusion, the outer diameter of which is slightly larger than the minimum of the inner diameter of the corrugated outer conductor of the coaxial cable. As will be further described hereinbelow, when the connector is mounted on the end of the suitably prepared cable, the end of said outer conductor will pass over said protrusion, which is possible due to the resilient construction of said resilient bushing, which passing will produce an audible "click" and/or a vibration in the connector, which can be perceived by the person fitting the connector on the end of the cable. This "click" or vibration will thus indicate to the person fitting the connector that this has been properly positioned on the end of the cable. The inner diameter of said resilient bushing (i.e. the diameter of the hollow inner part hereof) varies so that said inner diameter is less at the end of said resilient bushing comprising said protrusion than at the other end hereof, this other end having an inner diameter substantially equal to the outer diameter of said tubular extension of the main body. When hereafter said main body and said bushing as a final step of the mounting of the connector on the cable is displaced relative to each other for instance by screwing said bushing onto said main body, said tubular extension of the main body will be displaced longitudinally in said resilient bushing, so that when during this displacement said inner diameter of the resilient bushing becomes less than said outer diameter of the tubular extension of the main body, the end hereof provided with said protrusion is being pressed radially outward towards the rigid ring member and thereby establishing electrical contact between the outer conductor and the main body as well as a firm and reliable mechanical attachment therebetween as described previously.

Thus according to a first aspect of the invention, there is provided auditory or tactile means for ascertaining the correct insertion of the cable in the connector.

According to a second aspect of the invention, there is furthermore provided a connector which establishes reliable electrical connections between said center terminal and said inner conductor and between said main body and said outer conductor respectively by carrying out the following series of steps: inserting the suitably prepared end of the coaxial cable in the connector to a point where said "click" and/or vibration is perceived; displacing the main body and the bushing of the connector longitudinally relative to one another for instance by screwing the bushing onto the main body until a stop position is reached, whereby said contacts are established.

BRIEF DESCRIPTION OF THE DRAWINGS

A preferred embodiment of the invention will now be described in more detail with reference to the accompanying drawings, in which.

DETAILED DESCRIPTION OF THE INVENTION

Figure 1:
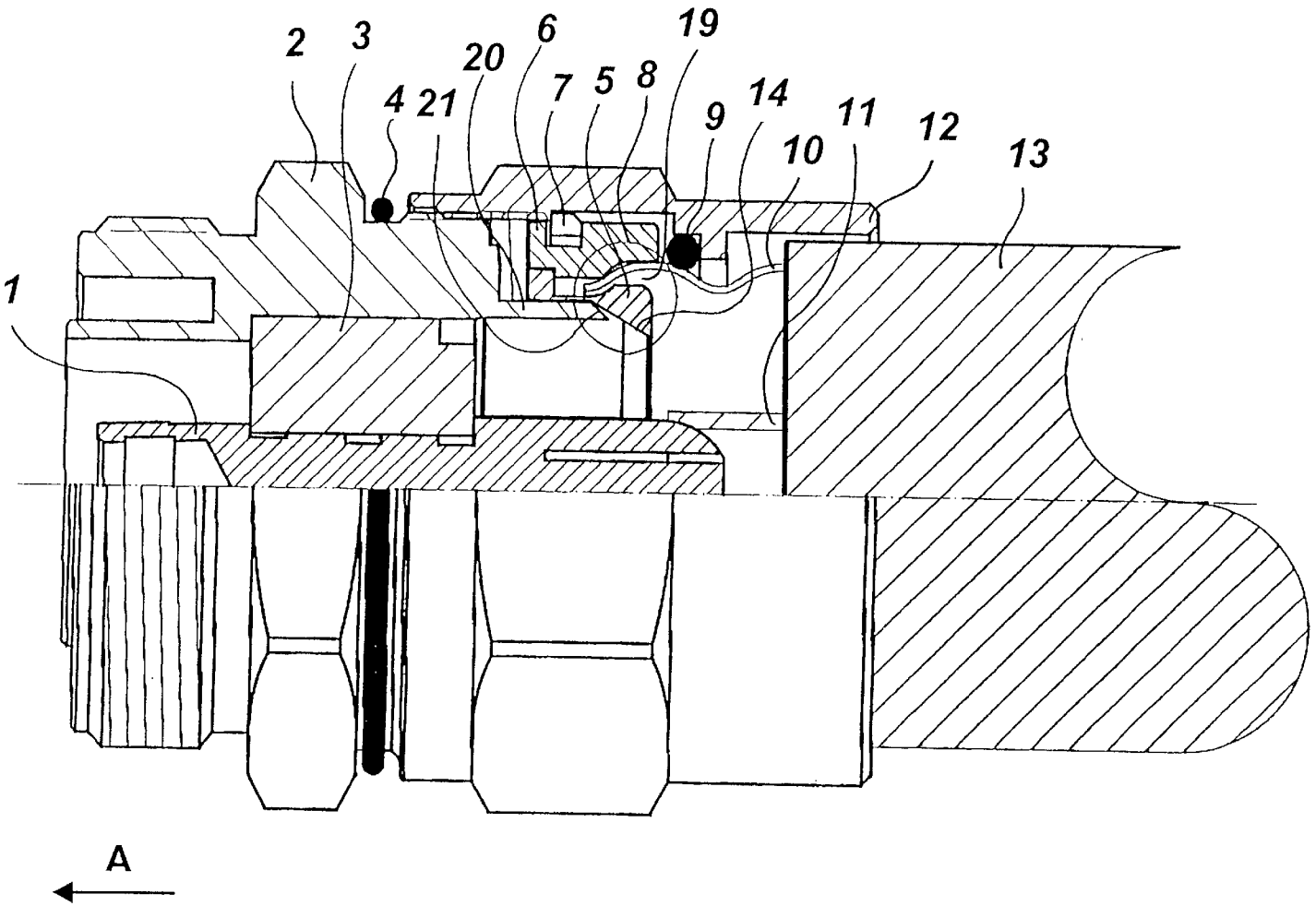
FIG. 1 is a longitudinal, partly sectional, view of a connector according to the present invention mounted on the end of a coaxial cable prior to the final displacement of the main body relative to the bushing.

In the following, a detailed description of one embodiment of the connector according to the invention will be given with reference to the drawing.

Referring to FIG. 1, there is shown a longitudinal, partly sectional, view of one specific embodiment of the connector according to the invention. The coaxial cable comprises the jacket 13, the corrugated outer conductor 10, the hollow inner conductor 11, and a suitable insulating material disposed between the inner conductor 11 and the outer conductor 10 (not shown in the figure). Prior to mounting of the connector on the end of the cable, the cable is suitably prepared to obtain the correct lengths of the ends of the outer and inner conductor, and so that said insulating material is removed in the end region of the cable. The cable thus assumes approximately the layout shown in FIG. 1.

The connector according to this embodiment of the invention comprises the main body 2, which is to be brought into a firm and reliable electrical and mechanical contact with the outer conductor 10, and the center terminal 1, which is to be brought into a firm and reliable electrical and mechanical contact with the hollow inner conductor 11. In order to provide the last mentioned contact, the center terminal 1 at the end hereof facing the cable is shaped and sliced as shown in FIG. 1, so that this end can be slightly compressed and therewith secure said firm and reliable contact with the inner conductor 11. The center terminal 1 is fixedly attached coaxially with the main body 2 by means of a tubular insulating means 3.

Part of the outer surface of said main body 2 is in this embodiment of the invention provided with threads enabling a tubular outer bushing 12 (hereinafter simply referred to as the bushing) to be displaced longitudinally and coaxially over said main body 2 by screwing said bushing 12, which on a part of the inner surface thereof is provided with threads, onto the main body 2.

The embodiment shown in FIG. 1 comprises: (a) the end portion of the main body 2 facing the cable, which end portion as previously will be referred to as the tubular extension 20 of the main body, where this tubular extension 20 in the present embodiment is provided with a conical end portion 21; (b) a one-sided resilient bushing 5; and (c) a rigid ring member 6.

Figure 2:
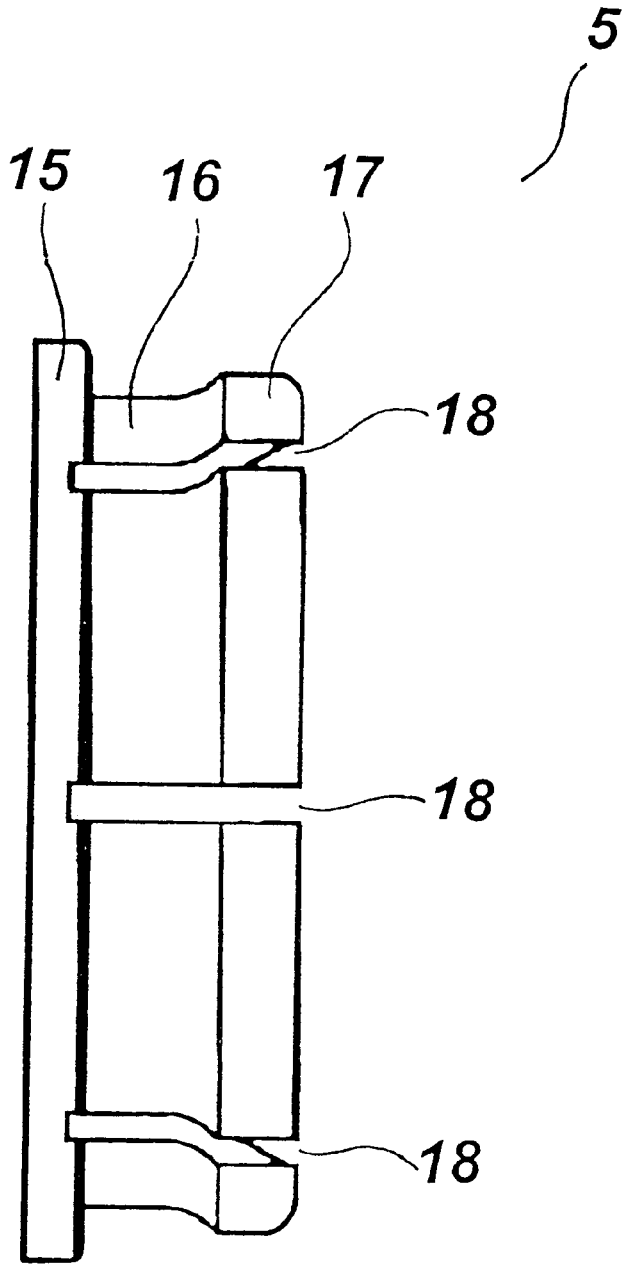
FIG. 2 is a side elevation view of a one-sided resilient bushing according to the present invention.

Placed coaxially and displaceable around said tubular extension 20 of the main body 2 is a one-sided resilient bushing 5, which is shown in somewhat more detail in FIG. 2. With reference to FIG. 2, the one-sided resilient bushing generally indicated by 5 comprises a tubular body, one end portion of which is provided with a number of longitudinally extending slits 18 through the wall of the bushing. Opposite the slits 18, is a circumferentially extending radially protruding collar 15, and at the end of the bushing 5 containing said slits 18, there is provided a radially protruding portion 17. Between said collar 15 and said protruding portion 17, there is provided a recessed portion 16. Due to the presence of the slits 18, the one-sided resilient bushing is thus able to undergo radial compression and/or expansion at one end hereof, whereas the diameter of the resilient bushing 5 is kept constant at the other end hereof.

As shown in FIG. 1, the inner diameter of the one-sided resilient bushing 5 changes from one end of the bushing towards the other. As described previously, the inner diameter at the end facing said collar 15 is substantially equal to the outer diameter of the tubular extension 20, so that the one-sided resilient bushing 5 can slide over the tubular extension 20. In this embodiment of the present invention, said inner diameter is kept constant over a certain length of the bushing 5, whereafter it decreases towards that end hereof comprising the protrusion 17. Specifically a linear decrease of diameter is shown in the figure, but the diameter could also decrease in other manners without affecting the overall inventive idea. The effect of this gradual reduction of inner diameter is, that when the bushing 5 is displaced over the tubular extension in a direction away from the coaxial cable, as indicated by the arrow A, the resilient end of the bushing 5 will be pressed radially outwards as the inner diameter of the bushing 5 becomes less than the outer diameter of the tubular extension 20.

Coaxially around said one-sided resilient bushing 5, there is provided a tubular rigid ring member 6. The dimensions of said rigid ring member 6 are such that a narrow gap 19 is formed between said resilient bushing 5 and said ring member 6. The ring member 6 is in engagement partly with the one-sided resilient bushing 5 via said circumferential collar 15 and a mating recess cut in the ring member 6 and partly with said bushing 12 via a suitable dimensioned retainer ring 7. A longitudinal displacement of the bushing 12 relative to the main body 2 in the direction indicated by the arrow A in FIG. 1 thus causes a corresponding displacement of the ring member 6 and the one-sided resilient bushing 5, so that these undergo a displacement over said tubular extension 20 of the main body 2. During this displacement, the one-sided resilient bushing 5 is thus being expanded radially, whereby the width of said gap 19 formed between the ring member 6 and the one-sided resilient bushing 5 is being reduced.

The mounting of the connector according to the invention requires the following steps: first the suitably prepared coaxial cable is being inserted in the connector to a point where the end of the outer conductor 10 touches the end of the one-sided resilient bushing 5. A further relative longitudinal displacement of the cable into the connector results in that the split-up end of the one-sided resilient bushing 5 is being compressed by the outer conductor 10, and the end of the outer conductor passes over the radially protruding portion 17 and down into the recessed portion 16 of the one-sided resilient bushing 5. This movement of the end of the outer conductor 10 over the protrusion 17 results in an audible "click" and/or the generation of a vibration, which can be perceived by the person mounting the connector on the cable. Hereafter the cable can be further longitudinally inserted in the connector until the point, where the end of the outer conductor 10 reached the collar 15 on the one-sided resilient bushing 5. The correct insertion of the cable into the connector is thus obtained.

Simultaneously with said relative displacement, the split-up end portion of the center terminal 1 of the connector is also being introduced within the hollow inner conductor 11 of the connector as described previously.

As a final step in the mounting of the connector on the cable, the bushing 12 is screwed onto the main body in the direction of the arrow A in FIG. 1. Due to the presence of sealing O-rings 4 and 9, a practically tight connection between the main body 2 and the bushing 12 is thus now obtained.

Preferred embodiments of the connector disclosed herein may be used for high frequencies.

Although one specific embodiment of the present invention has been shown and described in the preceding parts of the detailed description, it is understood that a person skilled in the art may conceive other embodiments of the invention without departing from the scope of the invention as defined by the following claims. For example the required resiliency of the bushing 5 may be obtained in a number of ways, and the shapes of the various details on the tubular extension 20, the resilient bushing 5 and the rigid ring member 6 may be optimized.

What is claimed is:

1. A connector for a coaxial cable comprising a main body (2) to be electrically connected to the outer conductor (10) of the coaxial cable, said outer conductor comprising an outer surface and an inner surface, and coaxially herewith provided with a center terminal (1) to be electrically connected to the inner conductor (11) of the coaxial cable and a tubular bushing (12) which can be displaced longitudinally and coaxially over said main body (2), wherein means (5,6) are provided between and coaxially with a tubular extension (20) of said main body (2) and said bushing (12), where said means (5,6) comprise a rigid ring member (6) in engagement with said outer surface of the outer conductor (10) and a radially resilient bushing (5) in engagement with said inner surface of the outer conductor (10) such that said resilient bushing (5) exerts a radially outwardly directed pressure on said inner surface.

2. The connector according to claim 1, wherein said rigid ring member (6) is in engagement with said bushing (12).

3. The connector according to claim 1, wherein said resilient bushing (5) is formed as a tubular body provided with a number of longitudinal slits (18) through the wall of the bushing (5), thereby making it possible to expand and/or compress said bushing (5).

4. The connector according to claim 3, wherein said longitudinal slits (18) extend from one end of said resilient bushing (5) to a point in the vicinity of the other end.

5. The connector according to claim 4, wherein said resilient bushing (5) on the radially outer surface thereof at the end from which said slits (18) extend is provided with a radially outwardly protruding portion (17), at the end thereof which is not provided with slits (18) is provided with a radially outwardly protruding circumferential collar (15) and that therebetween said protruding portion (17) and said collar (15) is provided a circumferentially extending recess (16) the outer diameter of which is less than the outer diameter of said protruding portion (17) and said collar (15).

6. The connector according to claim 5, wherein the inner diameter of said resilient bushing (5) varies longitudinally.

7. The connector according to claim 6, wherein said inner diameter of the resilient bushing (5) at the end hereof comprising said circumferential collar (15) is substantially equal to the outer diameter of said tubular extension (20) and at the other end of the resilient bushing (5) is less than said outer diameter of said tubular extension (20).

8. The connector according to claim 6, wherein said inner diameter of the resilient bushing (5) over a certain longitudinal distance from said end hereof comprising said collar (15), which longitudinal distance is less than the total longitudinal extension of the resilient bushing (5) is constant and substantially equal to the outer diameter of said tubular extension (20) and that said inner diameter over the remaining longitudinal extension of the resilient bushing (5) decreases linearly.

9. The connector according to claim 1, wherein the end of said tubular extension (20) facing the resilient bushing (5) is provided with a conical end portion (21).

10. The connector according to claim 1, wherein said rigid ring member (6) is in engagement with said bushing (12) so that a longitudinal displacement of the rigid ring member (6) is the result of a longitudinal displacement of said bushing (12) relative to said main body (2).

11. The connector according to claim 1, wherein said longitudinal displacement of the bushing (12) relative to the main body (2) is brought about by screwing said bushing (12) onto said main body (2) by means of threads provided on a part of the outer surface of said main body (2) and on a part of the inner surface of said bushing (12).

* * * * *